US005365495A

United States Patent [19]

Cussen

[11] Patent Number: 5,365,495

[45] Date of Patent: Nov. 15, 1994

[54] CLOCK DEVICE INCLUDING HOUR, DECADE AND UNIT MINUTE STATIONS

[76] Inventor: William J. Cussen, 20 Irwin Way, Apt. 620, Orinda, Calif. 94563

[21] Appl. No.: 150,614

[22] Filed: Nov. 10, 1993

[51] Int. Cl.[5] ..... G04B 19/00; G04C 19/00

[52] U.S. Cl. ..... 368/79; 368/82; 368/239

[58] Field of Search ..... 368/79, 82–84, 368/72–74, 223, 228, 239–242

[56] References Cited

U.S. PATENT DOCUMENTS

| | | | |
|---|---|---|---|
| 3,750,384 | 8/1973 | Miller et al. | 368/239 |
| 3,775,964 | 12/1973 | Fukumoto | 368/239 |
| 3,854,279 | 12/1974 | Edmunds | 368/79 |
| 4,185,283 | 1/1980 | Clark | 368/79 |
| 4,845,689 | 7/1989 | Vole | 368/82 |
| 4,995,018 | 2/1991 | Edwards | 368/107 |

*Primary Examiner*—Vit W. Miska
*Attorney, Agent, or Firm*—Harold D. Messner

[57] ABSTRACT

A clock device utilizing a hollow housing having stackable—columnar—first, second and third stations, each having a blinking light emitting diode (LED) controllably connected to a battery through a firm-wired or hardwired circuit with: the upper hour LED being energized first in sequence to present the hour of the predetermined time of day, by flashing such LED in accordance with a control algorithm or first pulse subcode to proved a total number of flashes contained in the time of day, viz., between 1 and 12; a mid-LED being next energized in accordance with a control algorithm or second pulse subcode that is decimally based, i.e., each flash denoting the number of ten minutes blocks or decades contained in the time of day; and a lower-LED being next being energized in accordance with a control algorithm or third pulse subcode that is also decimally based, each flash denoting a number of minute units in a particular 10-minute block, such number being between zero and nine. With such LED's being energized in serial fashion with the hour station providing a traditional hour display and the minute stations providing a decimal based displays, it has been found that children can learn to tell time and to count.

16 Claims, 5 Drawing Sheets

CLOCK DEVICE INCLUDING HOUR, DECADE AND UNIT MINUTE STATIONS

This invention relates to horology and more particularly to a clock device designed to assist in learning to tell time and count in ten-and one-minute increments in electrooptic fashion.

BACKGROUND OF THE INVENTION

Various forms of time pieces have been devised. Certain of such devices display the time in other that Roman or Arabic numbers. For example, in U.S. Pat. No. 4,757,484 special Mayan symbols are displayed on a row of panels. Hour glass designs are disclosed in U.S. Pat. No. 4,030,285. However, the traditional hours-minute type of display (a form of "analog" display) has continued to enjoy use because of such displays are adaptable to mechanically driven systems and are easily readable and comprehended by end-users.

In U.S. Pat. No. 3,841,526 there is suggested employing four binary coded indicators for hours, four binary coded indicators for 5 minutes increments and four indicators for one minute intervals. However, here again, the end-user has to translate a binary coder indication to hours and 5 minute intervals and this complicates the problem of comprehension, especially where the end-user is a small child since binary notation (versus decimal notation) translation is difficult to comprehend. Another technical problem in the practical realization of such a display is that there are many display elements required to provide the representation of hours and minutes. This large number presents assembly, reliability and power consumption problems to the manufacturer. In addition, the resulting clock is also costly to produce.

SUMMARY OF THE INVENTION

The clock device of the present invention utilizes a hollow housing having stackable—columnar—first, second and third stations, each having a blinking light emitting diode (LED) controllably connected to a battery through a firm-wired or hardwired circuit with: the upper hour LED being energized first in sequence to present the hour of the predetermined time of day, by flashing such LED in accordance with a control algorithm or first pulse subcode to proved a total number of flashes contained in the time of day, viz., between 1 and 12; a mid-LED being next energized in accordance with a control algorithm or second pulse subcode that is decimally based, i.e., each flash denoting the number of ten minutes blocks or decades contained in the time of day; and a lower-LED being next being energized in accordance with a control algorithm or third pulse subcode that is also decimally based, each flash denoting a number of minute units in a particular 10-minute block, such number being between zero and nine. With such LED's being energized in serial fashion with the hour station providing a traditional hour display and the minute stations providing a decimal based displays, it has been found that children can learn to tell time and to count. Also, since the maximum number of flashes is 12+5+9 and the minimum number is 1+0+0 per display, the power consumption is surprisingly low. Hence the display can also be used on a continuous basis to serve as a night light even though only battery powered

DETAIL DESCRIPTION OF EMBODIMENTS OF THE INVENTION

Figure 1:
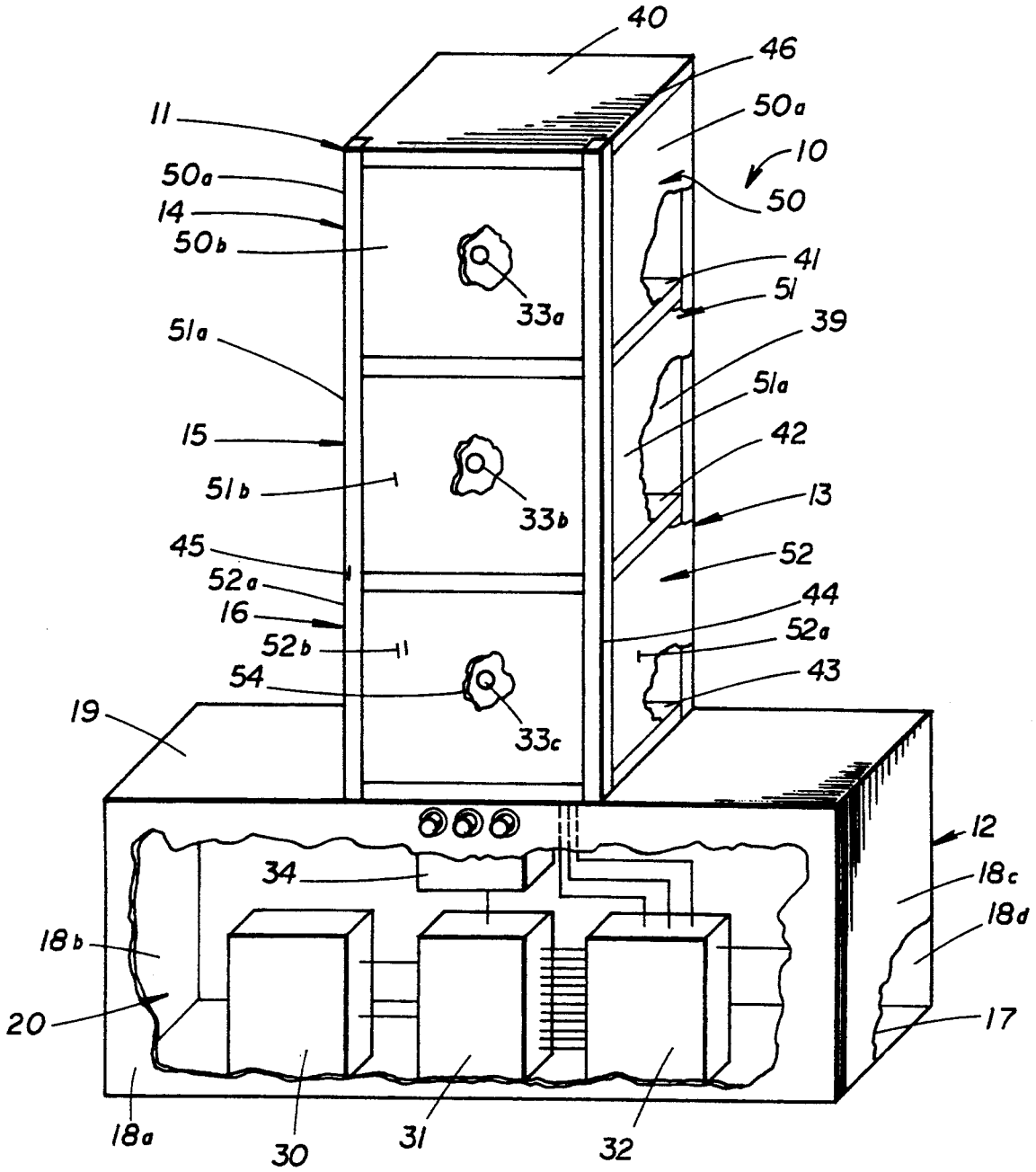
FIG. 1 is a schematic perspective view, partially broken away of a first embodiment of the clock device of the present invention shown a stacked column display driven by hardwired signal generating and control circuitry.

Now referring to FIG. 1, a first preferred embodiment of clock device 10 of the invention is shown. The clock device 10 comprises a hollow inverted Tee-shaped clock housing 11 including a horizontal base 12 and a vertical tower 13 defining stacked individual display stations 14, 15, and 16. The base 12 includes: (i) a floor 17, (ii) side walls 18*a*, 18*b*, 18*c* and 18*d* and (iii) a top wall 19. The items (i)–(iii) define a cavity 20.

Within cavity 20 are the following modules depicted in schematic fashion: battery module 30 powering a clock timing module 31 controlling signal generating logic circuit 32 which provides driving current for light-emitting diode (LED) 33*a* associated with display station 14, for driving LED 33*b* associated with display station 15 and for driving LED 33*c* associated with display station 16. Switches 34 are connected to the clock timing module 31 to regulate and control status of the clock device 10 as to: ON-OFF condition, reset condition and A.M. or P.M. status as explained below.

The tower 13 includes a solid upright back wall 39 extending from the top wall 19 of the base 12, and a series of cantilevered supports 40, 41, 42 and 43 extending from the back wall 40 at right angles. First and second posts 44, 45 also extend upward from the base 12 attached to aligned corners of the cantilevered supports 40–43 and terminates at upper ends 46. Between each of the cantilevered supports 40–43 and the posts 44, 45, are formed three sets of windows: top set 50, intermediate set 51 and lower set 52. The top set 50 is associated with display station 14 and includes a pair side windows 50*a* and a front window 50*b*. The intermediate set 51 is associated with display station 15 and includes a pair of side windows 51*a* and a front window 51*b*. The lower set 52 is associated with lower station 16 and includes a pair of side windows 52*a* and a front window 52*b*. Each of the windows 50*a*, 50*b*, 51*a*, 51*b*, 52*a* and 52*b* are framed by the cantilevered supports 40 43, vertical posts 44, 45 and the back wall 39 as well as includes a pane 54 of glass or plastic. Preferably, the colors of panes 54 vary from station-to-station, say green for the top set of windows 50, yellow for the intermediate set of windows 51 and red for the lower set of windows 52.

The display station 14 denotes the hour and the number of flashes varies between 1 and 12. That is, the light-emitting diode (LED) 33*a* is sequentially activated to flash the hour between 1 and 12. The display station 15 denotes the number of 10-minute increments in the time of day to be displayed and is called the decade station 15 for that reason. The number of 10-minute blocks to be displayed at LED 33*b* varies between zero to 5. That is, the light-emitting diode (LED) 33*b* is sequentially activated to flash the number of 10-minute increments associated with the time to be announced, between zero and 5. The display station 16 denotes the number of individual minutes within a given 10-minute increment (of the time to be determined) and hence is referred to as the unit station 16 in this Application. The number of unit minutes to be displayed at LED 33*a* varies between zero to 9. That is, the light-emitting diode (LED) 33*c* is sequentially activated to flash the number of minutes within a given 10-minute increment associated with the time to be announced, i.e., varies between zero and nine.

In operation, the stations 14, 15 and 16 are activated in sequence, i.e., station 14 first, followed by station 15 and then by station 16. In that way, the hour is first counted off, followed by the number of 10-minute increments associated with the time of day to be displayed, finally followed by the number of minutes within a given 10-minute increment previously counted off. That is, with the activation of the LED's 33*a*, 33*b* and 33*c* in serial fashion, the top display station 14 provides a traditional hour display followed by the activation of minute display stations 15 and 16 which together provide a decimal based translation of minutes segment of the time of day to be displayed. In this regard, it has been found that children can learn to tell time and to count from the clock device 10 of the invention. Also, since the maximum number of flashes is 12+5+9 and the minimum number is 1 +0+0 per display, the power consumption of the clock device 10 is surprisingly low. Hence the display can also be activated on a continuous bases to serve as a night light even though only battery powered.

CIRCUITRY

Figure 3:
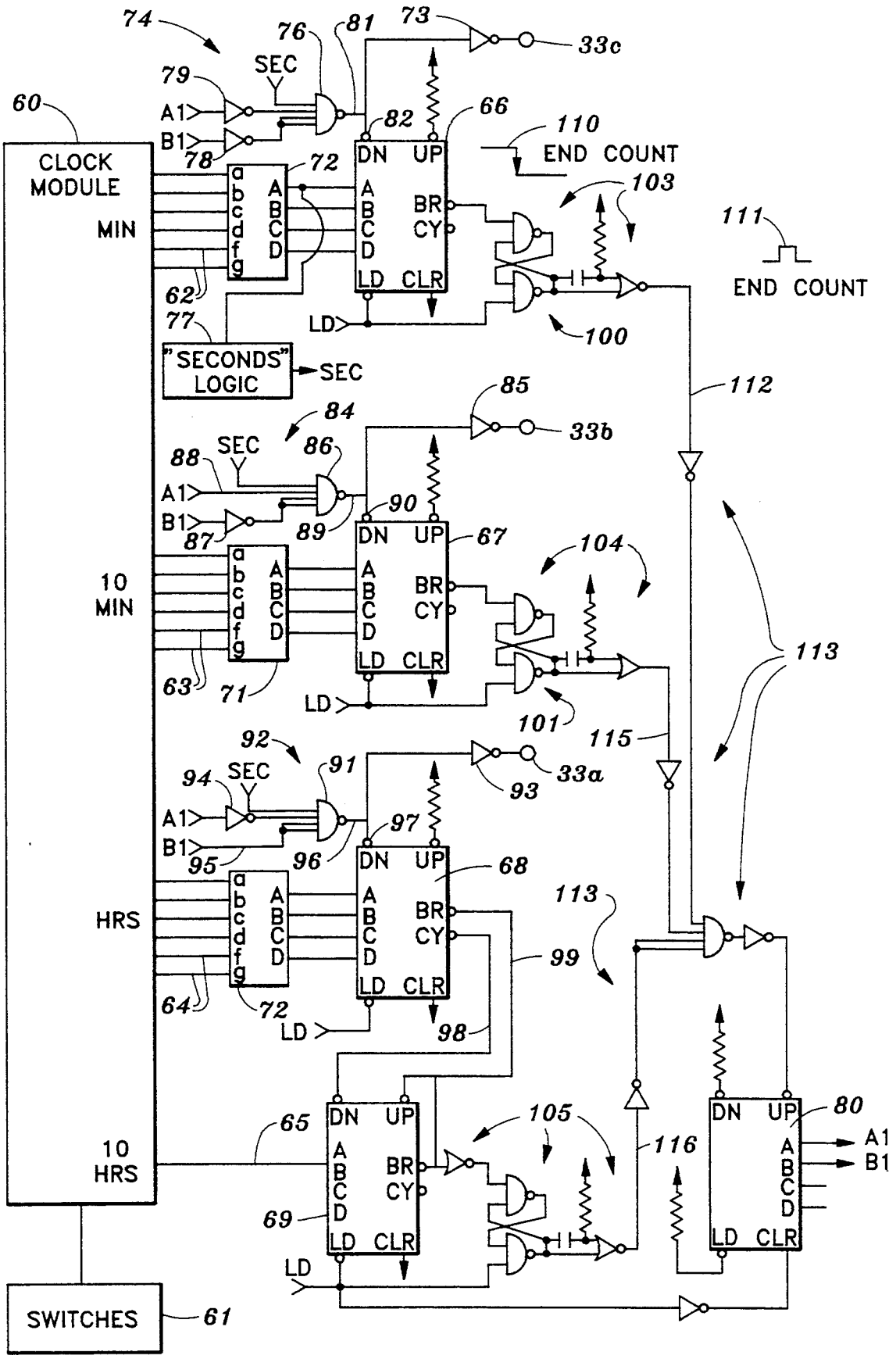
FIG. 3 is a schematic block diagram of the signal generating and control circuitry used in the clock device of FIG. 1.
Figure 4:
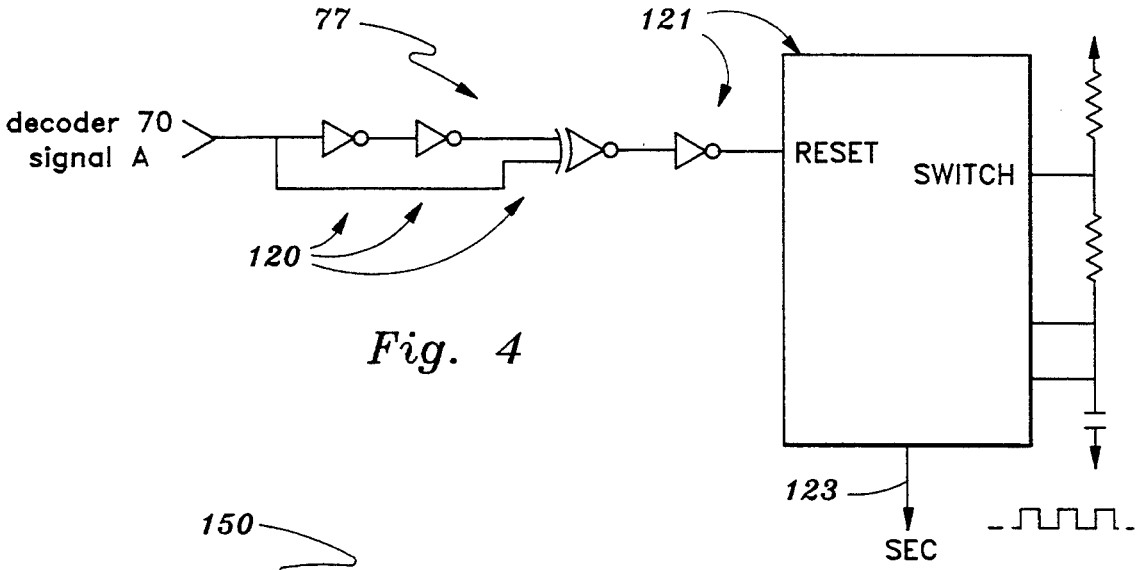
FIG. 4 is a schematic block diagram of a portion of the signal generating and control circuitry of FIG. 3.

While various control circuits may be used to operate the clock device 10 of the invention, FIGS. 1, 3 and 4 show a hardwired design in which the circuit elements have been reduced to a single application specific integrated circuit (ASIC). As shown in FIG. 3, clock module 60 are controlled by switches 61 and includes four sets of output conductors: minute outputs 62, 10-minute outputs 63, hour output conductors 64 and 10-times hours output conductor 65. The conductors 62–64 connect to counters 66, 67 and 68 through decoders 70, 71 and 72, respectively. The conductor 65 connect directly to counter 69.

The clock module 60 is a conventional device capable of providing synchronous digital data typically of a 12-hour cycle indicative of the time of day. In operation, seven segment drive line signals (SSDS's) indicative of the time of the day are outputted from the clock module 60 on the minute output conductors 62, on the 10-minute conductors 63, hour conductors 64 and 10-times hours conductor 65 in digital format. Such signals are first converted to binary coded decimal (BCD) notation by decoders 70–72 and then are used—ultimately—to generate a pulse code divided into three subcodes to cause sequential flashing of LED's 33*a*, 33*b* and 33*c* to visually indicate the time of day. In this regard, note that the circuitry of the invention thus performs a series of translations of the time of day from the clock module 60, viz, say first translates the hours portion of the time provided by the clock module 60 into a corresponding number of flashes to be observed at LED 33*a* by the user, and then translates the minute portion of the time of day into two portions: (i) 10-minute segments normalized from the hour, i.e., the number of 10-minute blocks the time of day represents counting from the hour, such number being translated into a corresponding number of flashes at LED 33*b* and (ii) minute segments normalized from the start of the 10-minute block, such number being translated into a corresponding number of flashes at LED 33*c*. Hence the minute portions of display are decimal based and easily decodable by the end-user.

In this regard assume SSDS's indicative of minute portion of the time of day are down loaded first. These signals pass from the clock module 60 through conductors 62, are converted to BCD notation at decoder 70 and then such BCD signals are used to down load the counter 66 to drive LED 33*c* through logic gate circuit 74 and driver 75. The logic gate circuit 74 is seen to include gate 76 having parallel inputs connected to the following: "seconds" logic circuit 77 set forth in detail in FIG. 4 and drivers 78, 79 connected to state counter 80 described below. Output line 81 of the gate 76 connects between driver 75 and terminal 82 of the counter 66. Details of the operations of the logic gate circuit 74 are set forth below.

In like manner, seven segment drive line signals (SSDS's) indicative of the 10-minute notation of the time of day are down loaded next, using the 10-minute output conductors 63. Such signals are first converted to binary coded decimal (BCD) notation by decoder 71 and the converted signals are then used to down load the counter 67 to drive LED 33*b* through logic gate circuit 84 and driver 85. The logic gate circuit 84 is seen to include gate 86 having parallel inputs connected to the following: "seconds" logic circuit 77 set forth in detail in FIG. 4, a driver 87 and line 88 connected to state counter 80 described below. Output line 89 of the gate 86 connects between driver 85 and terminal 90 of the counter 67. Details of the operations of the logic gate circuit 84 are set forth below.

Also in like manner, seven segment drive line signals (SSDS's) indicative of the hour of the time of day are finally down loaded, using the hours output conductors 64 and 65. First, the signals are converted to binary coded decimal (BCD) notation by decoder 72 which are then used to down load the counter 68 to drive LED 33*a* through logic gate circuit 92 and driver 93. The logic gate circuit 92 is seen to include gate 91 having parallel inputs connected to the following: "seconds" logic circuit 77 set forth in detail in FIG. 4, a driver 94 and line 95 both connected to state counter 80 as described below. Output line 96 of the gate 91 connects between driver 93 and terminal 97 of the counter 68. Details of the operations of the logic gate circuit 92 are set forth below.

In the case where the hour portion of the time of day is greater than 9, note that the clock module 60 signals counter 69 via conductor 65 and the counter 69 has output lines 98, 99 connected to hours counter 68. In this way, operations of the counters 68 and 69 can be interrelated to allow them—together—to make counts greater than nine.

The operations of state counter 80 will now be described in more detail in relation to generating signals for sequencing, for example, logic gates circuits 74, 84 and 92. Briefly, the state counter 80 is used as a sequencer for the aforementioned circuits of FIG. 3 as well as other circuit elements.

In more detail as shown in FIG. 3, the state counter 80 is designed to load all four counters 66, 67, 68 and 69 via request-for-display (LD) signals; and activate logic gate circuits 74, 84 and 92 to drive LED's 33*c*, 33*b* and 33*a*, respectively. In addition, the LD signals also sets all of the set-reset flipflops 100, 101 and 102 of logic circuit groups 103, 104 and 105, respectively. They also sequences the BCD signals from the decoders 70, 71 and 72 as well as clears state counter 80.

The operations of the state counter 80 will now be discussed in relation to generating the time of "12:59". The "LD" line of the counter 80 starts the sequence which can be designed to be (i) on demand, (ii) once only, (iii) repetitively or (iv) once per time period, say 30 seconds. For generating the time "12:59", note it requires 26 seconds to flash out the same. In this regard, assume that the "hour" (12) would be flashed first followed by the 10 minute number (5) followed in turn by the minute number (9). But the minute number (9) could be flashed first followed by the 10-minute number (5) followed in turn by the hour number (12).

If the second sequence note above is used, note that the following occurs: At load time (known at "LD" time), the A1 and B1 lines of the counter 80 will gate the "seconds" pulses generated by seconds logic circuit 77 through gate 76 of the logic circuit 74 to counter 66. Thus, each of the gated "seconds" pulses is used to both sequence the counter 66 and to energize LED 33*c* a total of 9 times. When the count reaches zero, the "borrow" line of counter 66 goes low. The downward edge 110 of the count transition from the counter 66 is then used to generate an end count pulse 111 at output line 112 of the logic circuit group 103 (via flip flops 100) which is then used by logic circuit group 113 to advance state counter 80. Then the sequence will be repeated as to flash LED 33*b* followed by LED 33*a* in a similar manner.

That is, the A1 and B1 lines of the counter 80 will gate the "seconds" pulses generated by seconds logic circuit 77 through gate 88 of the logic circuit 84 to counter 67. Thus, each of the gated "seconds" pulses is used to both sequence the counter 67 and to energize LED 33*b* a total of 5 times. When the count reaches zero, the "borrow" line of counter 67 goes low, The downward or trailing edge of count transition from the counter 67 is then used to generate an end count pulse at output line 115 of the logic circuit group 104 (via flip-flops 101) which is then used by logic circuit group 113 to advance state counter 80.

Next, the A1 and B1 lines of the counter 80 will gate the "seconds" pulses generated by seconds logic circuit 77 through gate 92 of the logic circuit 92 to sequence turn on the counters 68, 69.

Each "seconds" pulses is used to sequence both of the hours counter 68 and ten times counter 69 and to energize LED 33*a* a total of 12 times. When the count reaches zero, both of the "borrow" lines of the counters 68, 69 go low. The downward edge of the count transition from the counter 69 is then used to generate an end count pulse at output line 116 of the logic circuit group 105 which is then used by logic circuit group 113 to advance state counter 80 to a stop state wherein the A1 and B1 lines of the state counter 80 prevent any counting or LED flashing. That is to say, the counter 80 is called a "state" counter because it defines four separate states: (i) count/pulse related to minutes to be counted, (ii) count/pulse related to the ten-minute number to be counted out, (iii) count/pulse related to the hour number to be flashed and (iv) a stop state to end the display cycle.

FIG. 4 illustrates how the second pulses are generated via "seconds" logic circuit 77. As shown, the "seconds" logic circuit 77 includes logic group 120 connected to a gated oscillator 121. In operation, energization of line A of the decoder 70 is used to drive logic group 120 which generates a pulse at output line 122 for each pro-determined transition period (say once a minute). The pulse at output line 122 drives gated oscillator 121 which in turn generates a pulse ever second at output line 123. The pulse of output line 123 is used to drive logic circuits 74, 84 and 92 as explained above.

ALTERNATE EMBODIMENT (FIG. 2)

Figure 2:
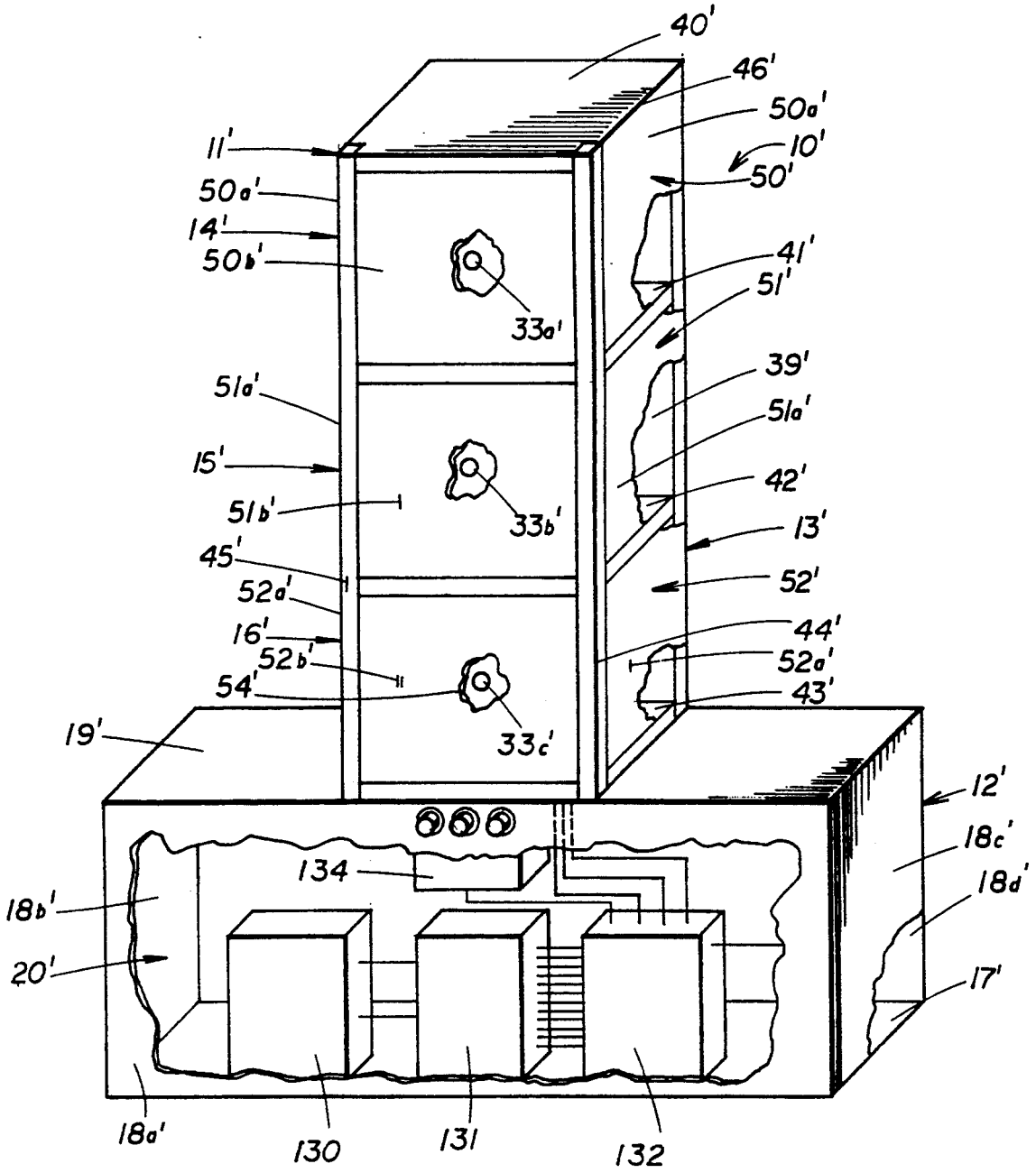
FIG. 2 is a schematic perspective view, partially broken away of a second embodiment of the clock device of the present invention shown a stacked column display driven by firmwired signal generating and control circuitry featuring a microprocessor.

Now referring to FIG. 2, a second embodiment of clock device 10' is shown. The clock device 10' is similar to the clock device 10 shown in FIG. 1.

That is, the clock device 10' of FIG. 2 comprises a hollow inverted Tee-shaped clock housing 11'. The housing 11' includes a horizontal base 12' and a vertical tower 13'. The tower 13' defines stacked individual display stations 14', 15', and 16'. The base 12' includes: (i) a floor 17', (ii) side walls 18*a'*, 18*b'*, 18*c'* and 18*d'* and (iii) a top wall 19'. The items (i)–(iii) define a cavity 20'.

Within cavity 20' are the following modules depicted in schematic fashion: battery module 130 powering a clock module 131 and a microprocessor 132 which provides driving current for light emitting diode (LED) 33*a'* associated with display station 14', for LED 33*b'* associated with display station 15' or for LED 33*c'* associated with display station 16'. Switches 134 are connected to the microprocessor 132 to regulate and control status of the clock device 10' as to: ON-OFF condition, reset condition and A.M. or P.M. status as explained below.

The tower 13' includes a solid upright back wall 39' extending from the top wall 19' of the base 12', and a series of cantilevered supports 40', 41', 42' and 43' extending from the back wall 40' at right angles. First and second posts 44', 45' also extend upward from the base 12' attached to aligned corners of the cantilevered supports 40'–43' and terminates at upper ends 46'. Between each of the cantilevered supports 40'–43' and the posts 44', 45', are formed three sets of windows: top set 50', intermediate set 51' and lower set 52'. The top set 50' is associated with display station 14' and includes a pair side windows 50*a'* and a front window 50*b'*. The intermediate set 51' is associated with display station 15' and includes a pair of side windows 51*a'* and a front window 51*b'*. The lower set 52' is associated with lower station 16' and includes a pair of side windows 52*a'* and a front window 52*b'*. Each of the windows 50*a'*, 50*b'*, 51*a'*, 51*b'*, 52*a'* and 52*b'* are framed by the cantilevered supports 40'–43', vertical posts 44', 45' and the back wall 39' as well as includes a pane 54' of glass or plastic. Preferably, the colors of panes 54', vary from station-to-station, say green for the top set of windows 50', yellow for the intermediate set of windows 51' and red for the lower set of windows 52'.

In operation, the stations 14', 15' and 16' are activated in sequence, i.e., say station 14' first, followed by station 15' and then by station 16'. In that way, the hour is first counted off, followed by the number of 10-minute increments associated with the time to be announced, finally followed by the number of minutes within a given 10-minute increment previously counted off. That is with the activation of the LED's 33a', 33b' and 33c' in serial fashion, the top display station 14' provides a traditional hour display followed by the activation of minute display stations 15' and 16' to providing a decimal based minute display of the time to be announced. In this regard, it has been found that children can learn to tell time and to count from the clock device 10' of the invention. Also, since the maximum number of flashes is 12+5+9 and the minimum number is 1+0+0 per display, the power consumption of the clock device 10 is surprisingly low. Hence the display can also be activated on a continuous bases to serve as a night light even though only battery powered.

CIRCUITRY

Figure 5:
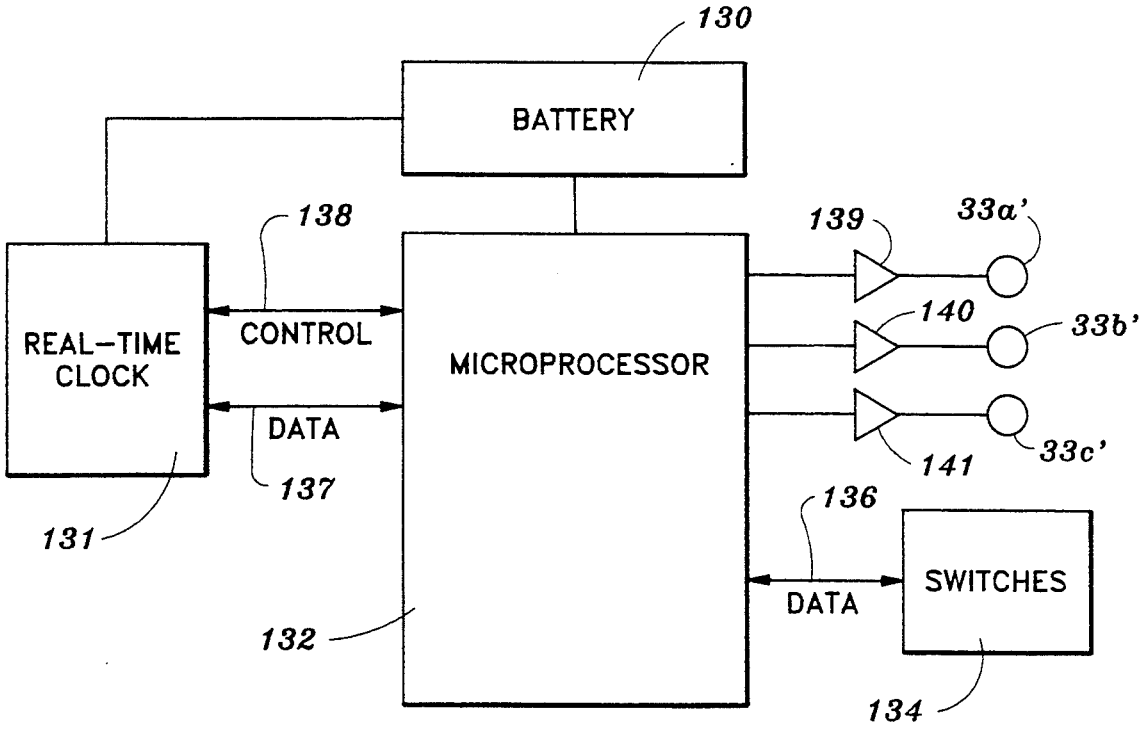
FIG. 5 is a schematic block diagram of the signal generating and control circuitry used in the clock device of FIG. 2 utilizing a properly programmed microprocessor.

FIG. 5 shows the clock module 131 and microprocessor 132 in more detail. The clock module 131 is a conventional device providing synchronous digital data typically of a 12-hour cycle indicative of the time of day. In operation, seven segment drive line signals (SSDS's) indicative of the time of the day in digital form are outputted from the clock module 131 via data bus line 137 under control of control signal on control bus line 138. Such signals are first converted to binary coded decimal (BCD) notation by decoders within the microprocessor 132 and then such BCD signals are used to control circuit elements within the microprocessor 132 to generate control signals for driving drivers 139 to cause sequential flashing of selected translations of the time of day at LED's 33a', 33b' and 33c'. In this regard, note that the microprocessor 132 thus performs a series of translations of the time of day. I.e., the microprocessor 132 say first translates the hours portion of the time provided by the clock module 131 into a corresponding number of flashes at LED 33a', and then translates the minute portion of the time of day into two portions: (i) 10 minute segments normalized from the hour, i.e., the number of 10-minute blocks the time of day represents counting from the hour, such number being translated into a corresponding number of flashes at LED 33b' and (ii) minute segments normalized from the start of the 10-minute block, such number being translated into a corresponding number of flashes at LED 33c'.

For this purpose, note that such microprocessor 132 must be a programmable microprocessor of digital design and have sufficient number of output lines 135 to correspond to the LED 33a', 33b' and 33c' to be sequentially flashed. The microprocessor 132 is thus conventional and is powered by battery module 130. A number of commercially available microprocessors can be used. Note also the microprocessor 132 is connected to switch module 134 via a data bus 136. The switch module 134 are used to set the following: ON-OFF condition, reset condition and A.M. or P.M. status as well as delay of occur between a given time rendition (once, continuous, every 2 minutes, etc.), and between flashes within a given rendition.

In operation, the real time clock module 131 is set in accordance with the output from the switch module 134 and then the microprocessor 132 reads the clock output via data bus line 137. Mode selection (READ-WRITE) as well as internal digit selection modes are provided via control bus line 138. As previously mentioned, external user-friendly selections are provided by switch module 134 connected to the microprocessor 132 via data bus line 136. Operation of the microprocessor 132 is straight-forward in providing drive current to sequencing activate LED's 33a', 33b' or 33c' via drivers 139, 140 and 141, respectively via a built-in program usually burned into a ROM within the microprocessor 132.

Figure 6:
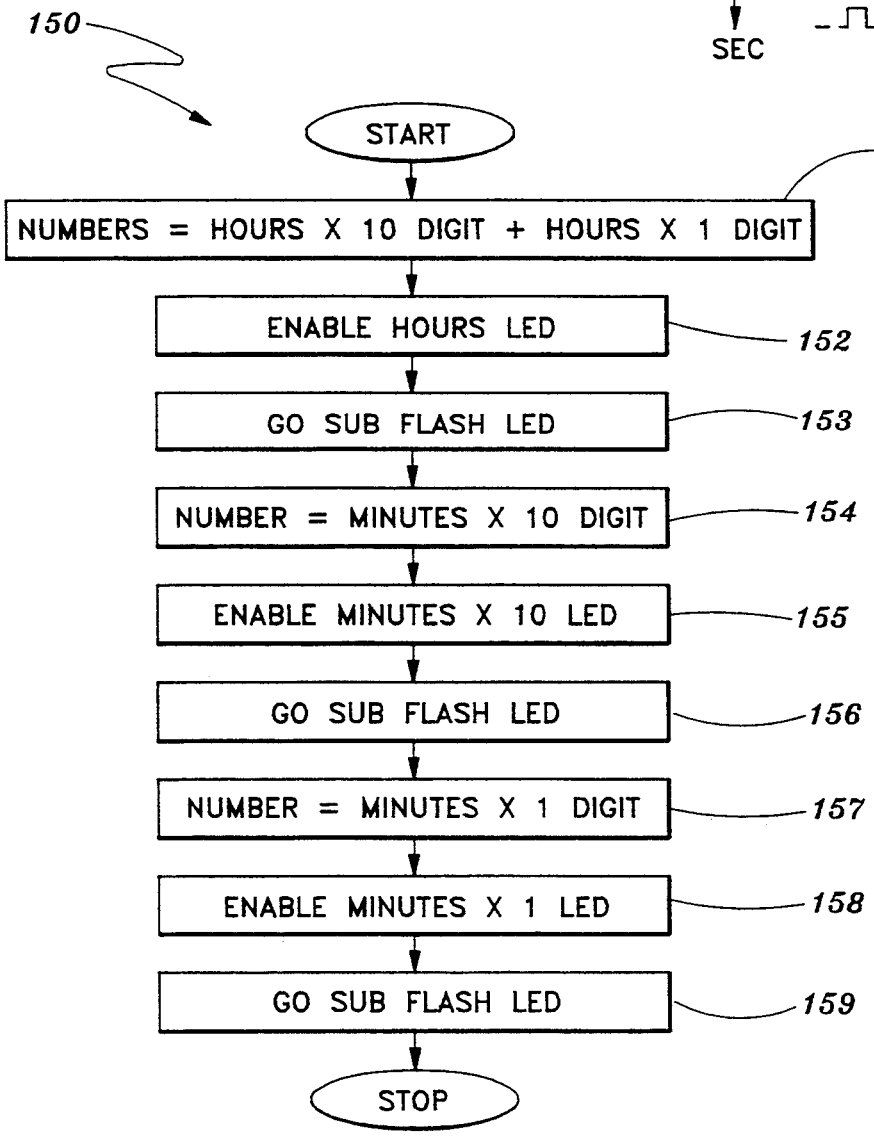
FIG. 6 is a logic flow chart of the time-generating and display sequences employing the firmwired embodiment of FIGS. 2 and 5.

FIG. 6 shows a flow chart 150 illustrating the algorithm or steps for controllably enabling the LED's 33a', 33b' and 33c' of FIG. 5.

First, in step 151, data denoting the hour, 10-minute notation, and minute value is read by the microprocessor after the correct mode selection (READ) and digit selection has been provided. By the term "digit selection" it is meant that a particular LED (hour, 10-minute or minute) is selected.

In this regard, assume the hour digit is to be first displayed. Hence, in step 151 the 10-hours digit is multiplied by 10 and then is added to the hours digit resulting in a number X that is the time in hours. The hours LED is enabled at step 152 and flashed X times at step 153. Next, in step 154 the 10-minute digit is read which is a number the user is to multiply by ten. The 10-minute LED is enabled at step 155 followed by sequential flashing at step 156. Finally, in step 157 the minute digit is read which a number the user uses within the ten-minute increment. The minute LED is enabled at step 158 followed by sequential flashing at step 159.

Figure 7:
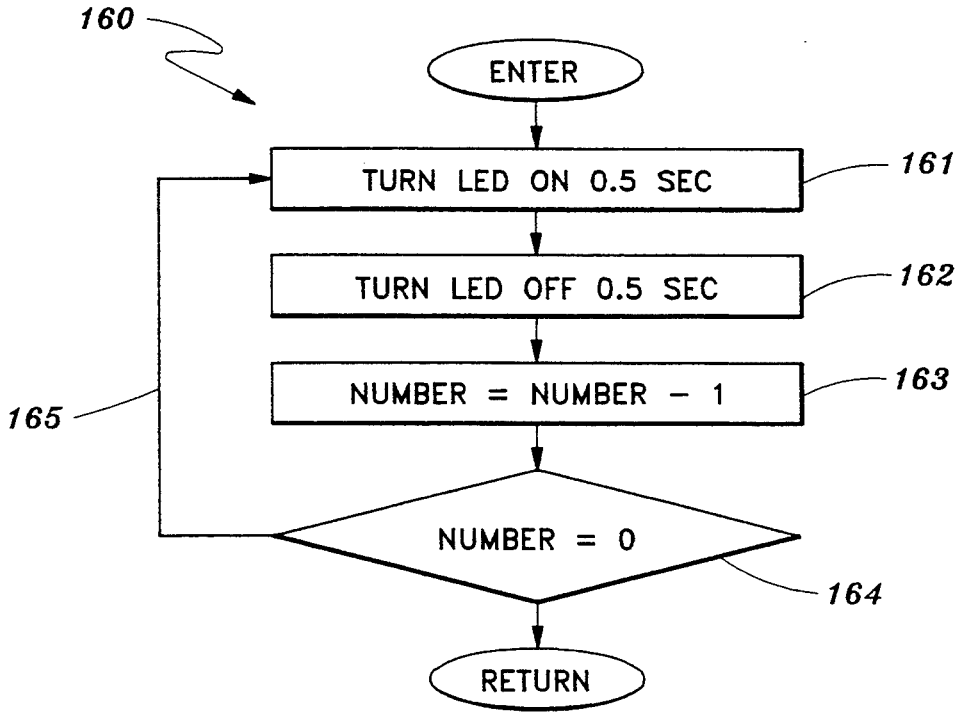
FIG. 7 is a logic flow chart of a portion of the logic diagram of FIG. 6 to show flashing of the clock device of FIG. 2.

FIG. 7 shows a logic chart 160 showing the algorithm by which the hours LED, the 10-minute LED and minute LED is flashed as set forth in steps 153, 156 and 159 of the logic chart 150 of FIG. 6.

As shown, in step 161 the LED is enabled so that a timing loop is run that lasts about ½ second. Next, in step 162, the LED is disabled via a second timing loop of about ½ second duration. Then, in step 163 there is decrementation of the original digit number by one. In step 164, the resulting decremented number is tested to see if it is zero. If it is not zero, the process returns to step 161 via loop 165. If the number is zero, the subroutine stops.

Obviously, other embodiments and modifications of the invention will readily come to those of ordinary skill in the art having the benefit of the teachings present in this description and drawings. It is therefore to be understood that such various changes are to be considered within the principles and scope of the invention.

What is claimed is:

1. An electrooptical clock device for generating and displaying the time of day, comprising display means for displaying time of day as separate hour, 10-minute and minute decimally based count translations thereof, including a plurality of lights, said display means comprising three lights in which one such light is associated with said hour count translation only, another such light is associated with said 10-minute count translation only and yet another such light is associated with minute count translation only, a clock module for generating clock data in digital format indicative of the time of day in hour, 10-minute and minute segments, said 10-minute segment being normalized relative to said hour segment and said minute segment being normalized relative to said 10-minute segment, generating and control means for translating said clock data of said clock module into a series of drive signals indicative of said time of day in hour, 10-minute and minute data blocks for causing blinking of said lights of said display means in sequence, said drive signals associated with said hour, said 10-minute and said minute data blocks driving said lights of said display means in sequence, said one light being activated and then deactivated wherein total number of activations is between 1 and 12 and is indicative of said hour count translation of said time of day, said another light being activated and then deactivated wherein total number of activations is between 1 and 5 and is indicated of said 10-minute count translation of said time of day, said yet another light being activated and then deactivated wherein total number of activations is between 1 and 9 and is indicative of said minute count translation of said time of day, wherein said 10-minute and minute data blocks are separately and sequentially displayed as decimally based blinking translations of said minute segments of said clock data thereby permitting children to learn to distinguish minute segments of said time of day and to count.

2. The electrooptical clock device of claim 1 in which said lights of said display means are each a LED controlled by said drive signals to blink a series of times corresponding to separate hour, 10-minute and minute decimally based count translations of the said time of day generated by said clock module,

3. The electrooptical clock device of claim 2 in which said display means includes an upright housing partitioned into three stations, defining a series of windows and containing said LED's wherein blinking thereof are viewable through said series of windows, said windows being provided with different translucent colors.

4. The electrooptical clock device of claim 1 including a battery module for powering said clock module and said generating and control means.

5. The electrooptical clock device of claim 4 in which said generating and control means comprises a programmable microprocessor and a series of output drivers connected to said series of lights.

6. The electrooptical clock device of claim 5 in which series of lights are LED's.

7. The electrooptical clock device of claim 1 including a battery module for powering said clock module and said generating and control means.

8. The electrooptical clock device of claim 7 in which said generating and control means comprises an application specific integrated circuit (ASIC) including a series of output drivers connected to said series of lights.

9. The electrooptical clock device of claim 8 in which series of lights are LED's.

10. The electrooptical clock device of claim 8 in which said ASIC includes a series of decoders for converting said clock data to BCD notation, a series of counters connected to the outputs of said decoders to provide a series of hour, 10-minute and minute pulse count codes corresponding to said hour, 10-minute and minute segments of said clock data of said clock module and logic circuits at the output of said counters to drive said LED's in sequence in accordance with said hour, 10-minute and minute pulse count code.

11. The electrooptical clock device of claim 10 with the addition of a series of logic circuits connected to outputs of said counters and operative in accordance with a trailing edge of an end count of each of said hour, 10-minute and minute pulse count codes to generate an end pulse.

12. The electrooptical clock device of claim 11 with the addition of a state counter connected to said series of logic circuits to accept said generated end pulse and change operational state of said ASIC.

13. A method of generating and displaying the time of day, to teach children to tell time and count comprising the steps of:

(i) generating clock data in digital format indicative of the time of day in hour, 10-minute and minute segments, said 10-minute segment being normalized relative to said hour segment and said minute segment being normalized relative to said 10-minute segment, (ii) translating said clock data into a series of drive signals indicative of said time of day in hour, 10-minute and minute data blocks, each data block being associated with time of day as separate hour, 10-minute and minute decimally based count translations thereof, (iii) displaying said hour, 10-minute and minute data blocks in sequence at three lights in which one such light is associated with said hour count translation only, another such light is associated with said 10-minute count translation only and yet another such light is associated with minute count translation only, by causing said one light to be activated and then deactivated wherein total number of activations is between 1 and 12 and is indicative of said hour count translation of said time of day, said another light to be activated and then deactivated wherein total number of activations is between 1 and 5 and is indicated of said 10-minute count translation of said time of day, said yet another light to be activated and then deactivated wherein total number of activations is between 1 and 9 and is indicative of said minute count translation of said time of day, wherein said 10-minute and minute data blocks are separately and sequentially displayed as decimally based blinking translations of said minute segments of said clock data thereby permitting children to learn to distinguish minute segments of the time of day and to count.

14. The method of claim 13 in which the steps (ii) and (iii) are in accordance with an algorithm that automatically carries them out.

15. The method of claim 13 in which said drive signals of step (ii) is a pulse code having three subcodes related said hour, 10-minute and minute data blocks respectively.

16. The method of claim 15 in which the lights of step (iii) are LED's driven into a blinking pattern in sequence, by the first subcode to visually indicate the hour of the time of day at said one LED, by the second subcode to visually indicate the number of 10-minute segments in the time of day at said another LED, and by the third subcode to visually indicate the number of minutes within a given 10-minute segment at said yet another LED.

* * * * *